United States Patent [19]

Nattrass

[11] Patent Number: 4,822,179

[45] Date of Patent: Apr. 18, 1989

[54] SEMI-BULK TRANSPORT BAGS WITH LIFTING MEMBERS OF BAG MATERIAL

[75] Inventor: Peter J. Nattrass, Barrington Hills, Ill.

[73] Assignee: Bulk Lift International Incorporated, Carpentersville, Ill.

[21] Appl. No.: 6,625

[22] Filed: Jan. 22, 1987

Related U.S. Application Data

[63] Continuation-in-part of Ser. No. 631,455, Jul. 16, 1984, abandoned, which is a continuation-in-part of Ser. No. 542,587, Oct. 17, 1983, abandoned.

[51] Int. Cl.[4] ..... B65D 33/02; B65D 33/10; B65D 33/14; B65D 88/22

[52] U.S. Cl. ..... 383/17; 383/20; 383/22; 383/24; 383/117

[58] Field of Search ..... 383/6, 8, 16–20, 383/22, 24, 41, 901, 906, 117; 222/105, 181

[56] References Cited

U.S. PATENT DOCUMENTS

| | | | |
|---|---|---|---|
| 612,249 | 12/1898 | Nickerson | 383/24 X |
| 733,542 | 7/1903 | Converse | 383/17 X |
| 1,428,617 | 9/1922 | Thaw | 383/18 |
| 1,953,962 | 4/1934 | Kinney | 383/24 |
| 4,010,784 | 3/1977 | Nattrass et al. | 383/17 |
| 4,143,796 | 3/1979 | Williamson et al. | 383/41 X |
| 4,207,937 | 6/1980 | Sandeman et al. | 383/17 |
| 4,221,250 | 9/1980 | Manerba | 383/24 |
| 4,300,608 | 11/1981 | Cuthbertson | 383/22 X |
| 4,301,848 | 11/1981 | Beaven et al. | 383/20 |
| 4,307,764 | 12/1981 | Nattrass | 383/17 X |
| 4,356,853 | 11/1982 | Sekiguchi | 383/24 |
| 4,457,456 | 7/1984 | Derby et al. | 222/181 X |
| 4,480,766 | 11/1984 | Platt | 383/24 X |
| 4,493,109 | 1/1985 | Nattrass | 383/7 |

FOREIGN PATENT DOCUMENTS

| | | | |
|---|---|---|---|
| 1696 | 5/1979 | European Pat. Off. . | |
| 2215675 | 10/1973 | Fed. Rep. of Germany | 383/6 |
| 2824940 | 12/1979 | Fed. Rep. of Germany | 383/24 |
| 360733 | 11/1931 | United Kingdom | 383/16 |
| 1581437 | 12/1980 | United Kingdom . | |
| 2050298 | 1/1981 | United Kingdom . | |
| 1591866 | 6/1981 | United Kingdom . | |
| 2063816 | 6/1981 | United Kingdom | 383/6 |
| 1602726 | 11/1981 | United Kingdom | 383/17 |
| 2116143 | 9/1983 | United Kingdom | 383/17 |

*Primary Examiner*—Sue A. Weaver
*Attorney, Agent, or Firm*—Kinzer, Plyer, Dorn, McEachran & Jambor

[57] ABSTRACT

Semi-bulk transport bags having wide lifting members, each lifting member formed from a plural layer folded strip of plain fabric woven from flat ribbon tape, of the same type as used for the bodies of the bags; these relatively stiff lifting members are anchored at the tops of the bags, and are positioned to distribute lifting stresses across wide segments of the side panels. One construction uses four lifting loop members, one at each corner of a rectangular bag; the edges of the ends of each loop are overlapped and tacked into the bag corner by the corner seams that join the side panels of the bags, without folding the side panels over the lifting members, materially reducing manufacturing costs. In another construction, using only two lifting members, the ends of each lifting member are anchored into wide vertical hems on just two side panels of a rectangular bag, allowing use of a lighter weight plain fabric material for the other two side panels without sacrifice of bag strength. In yet another construction using four lifting members, the opposite ends of each lifting member are attached to top portions of the side panels of the bag body but spaced from each other; variations include a rectangular bag and a generally circular bag. Each lifting member is formed with a single twist to stiffen the lifting member and to equalize load stress when the bag is lifted.

6 Claims, 5 Drawing Sheets

Fig. 1.
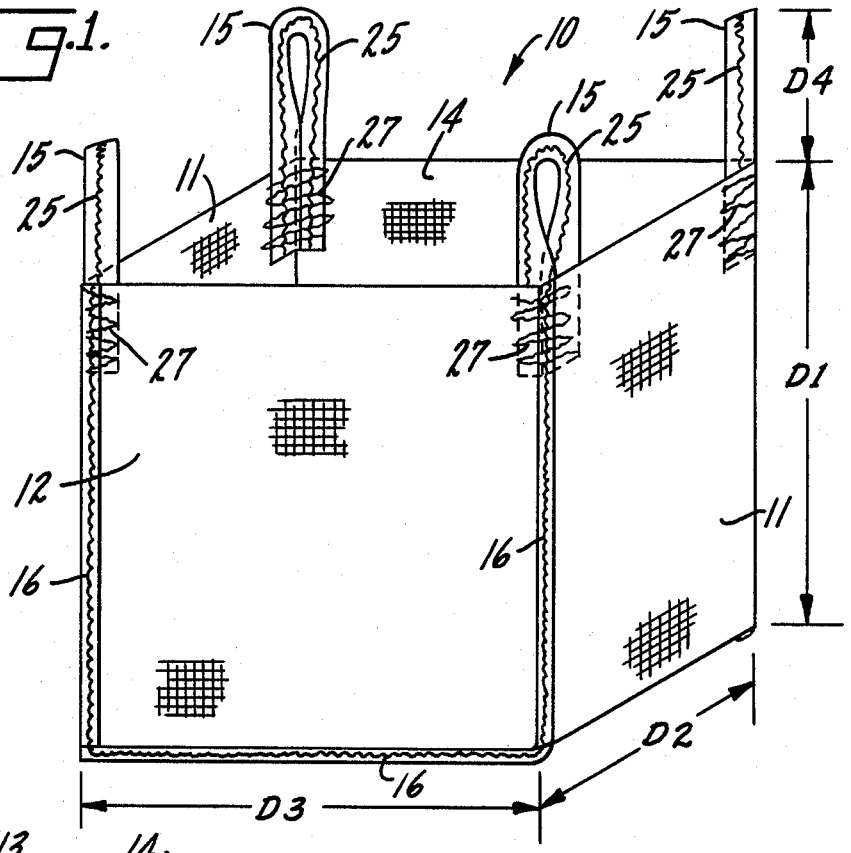
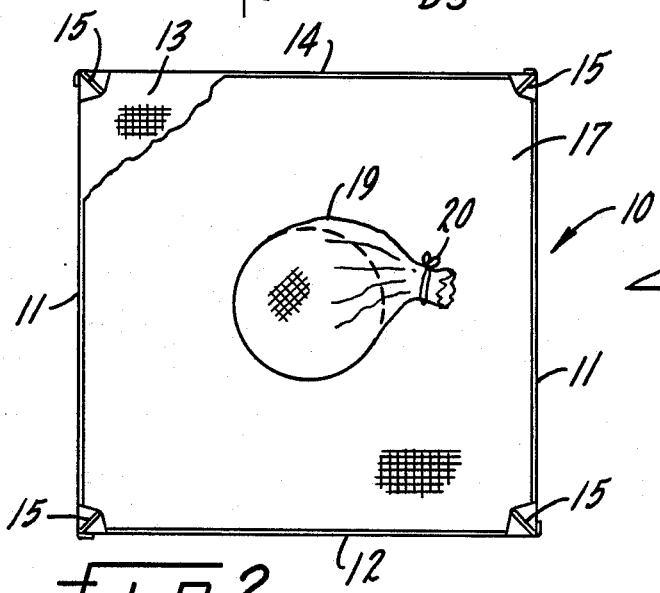
Fig. 2.
Fig. 3.
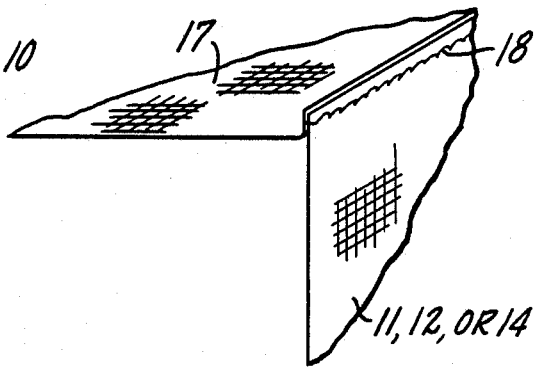
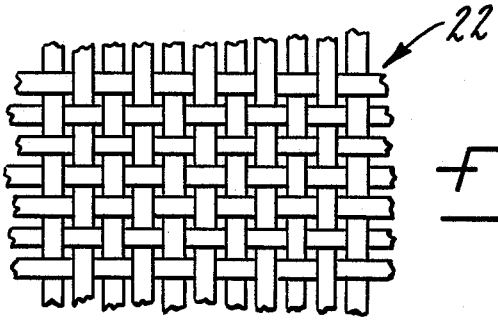
Fig. 4.

SEMI-BULK TRANSPORT BAGS WITH LIFTING MEMBERS OF BAG MATERIAL

This is a continuation-in-part of a co-pending application Ser. No. 631,455 filed July 16, 1984, which is a continuation-in-part of application Ser. No. 542,587, filed Oct. 17, 1983; Ser. No. 542,587 and Ser. No. 631,455 have both been abandoned.

BACKGROUND OF THE INVENTION

The use of large fabric bags for shipment of semi-bulk quantities of granular materials, powders, and other commodities has increased appreciably in recent years. These bags, referred to as semi-bulk transport bags, are too large to be man-handled; each is equipped with a harness so that the bag can be moved about by a fork-lift truck or other similar material handling equipment. In general, semi-bulk transport bags as used commercially have been of rectangular configuration, though other shapes have been employed. The weight capacity for a bag of this type is usually at least one ton; generally speaking, the upper limit is about four tons. The volumetric capacity of a bag of this kind ordinarily exceeds twenty cubic feet.

It is not particularly difficult to achieve adequate bag body holding strength for the one to four ton capacity required of a semi-bulk transport bag; commercially available relatively inexpensive bag fabrics and conventional industry sewing techniques are quite adequate for this purpose. Relatively coarse, heavy, plainwoven fabrics, woven from flat ribbon tape, are regularly employed. The critical part of virtually any semi-bulk transport bag, however, is the connection between the lifting loops or other lifting harness and the body of the bag itself. That is, the most common source of failure in a semi-bulk transport bag occurs at the connections between the lifting loops, formed of high-strength webbing, and the body of the bag, the points at which lifting stress is transferred to the bag body. This stress is often substantially in excess of the weight of the bag contents, particularly if the operator of a fork-lift truck is somewhat careless or abrupt in moving the bag.

It is conventional wisdom that the lifting loops or other similar harness for a semi-bulk transport bag should be formed from high density webbing of the kind commonly used for automobile seat belts. Webbing of this kind, a narrow, strong fabric closely woven or braided and designed for bearing weight, is much stronger than the plain, flat ribbon tape woven materials used in the bodies of the bags. Furthermore, though considerably more expensive than the materials used for bag bodies, the cost of webbing loops and harnesses has been considered acceptable, partly because standard webbing of approximately two inches width is employed in great quantities in automobile seat belts and hence is less expensive than special purpose webbing. Examples of semi-bulk transport bags that use webbing for the lifting loops or other harness include Sandeman et al U.S. Pat. No. 4,207,937, Manerba U.S. Pat. No. 4,221,250, and others mentioned below.

To distribute the lifting stress from the webbing loops or other harness to the body of a semi-bulk transport bag, a variety of different attachment arrangements have been proposed. For the most part, these critical mounting arrangements for the lifting loops have entailed folding the bag material into multiple layers and anchor stitching the lifting harness webbing to the folded bag material, usually with the loop webbing captured within the folds of the bag material. Arrangements of this kind are disclosed in Nattrass et al U.S. Pat. No. 4,010,784, Beaven et al U.S. Pat. No. 4,301,848, Nattrass U.S. Pat. No. 4,307,764, and Goodbody British Pat. No. 1,591,866. Some of these arrangements have been quite effective and have seen widespread commercial use. However, any of these techniques requiring multiple folding of the bag material at the point of attachment to a lifting loop or other webbing harness member add materially to the cost of bag manufacture.

Another technique that has been adopted in an attempt to meet the critical requirements for attachment of a webbing loop or other harness member to the body of a semi-bulk transport bag is to extend the webbing for most or all of the height of the bag and attaching the webbing to the bag throughout its height. Bags which employ this technique are shown in Williamson et al U.S. Pat. No. 4,143,796 and in Nattrass published European Patent Application No. 1696. This expedient, however, is undesirable because of the substantial increase in cost entailed in the use of long lengths of relatively expensive webbing.

In some prior art bags there are no separate lifting loops as such. Instead, opposed side walls are extended upwardly above the bag top. In Derby et al British patent application No. 2,050,298, published Jan. 7, 1981, these side wall extensions are folded over with their edges sewn to the top edges of those side walls to afford two tunnel-like lifting loops each extending the full width of the bag. In LoLift British Pat. No. 1,581,437 the side wall extensions are joined together at the center of the bag to form a single tunnel-like lifting member. These arrangements are awkward to mount on the tines of a fork-lift truck and the tunnel-like loops are rather easily damaged in use.

In many ways the use of closely woven or braided high-density webbing in the lifting loops or other harness of a semi-bulk transport bag is essentially self-defeating. The webbing is excellent in providing the harness strength necessary to permit lifting of the loaded bag by a fork-lift truck or other similar material handling equipment, but accentuates the problems at the critical point of connection to the body of the bag, due to the limited surface area of the webbing. One possible solution to this difficulty would be the use of webbing having widths substantially in excess of the standard two inch width, because the wider webbing allows for distribution of the lifting stress over a greater width of the plainwoven fabric constituting the body of the bag. But webbing in widths substantially exceeding two inches is difficult to obtain and non-standard webbing is excessively expensive for this application.

SUMMARY OF THE INVENTION

It is a principal object of the present invention, therefore, to provide a new and improved construction for a semi-bulk transport bag that uses the same woven material that constitutes the body of the bag in the lifting members for the bag, eliminating all webbing in the lifting harness, in a construction that is effective to provide better distribution of lifting stresses from the lifting harness to the body of the bag than has been possible using conventional webbing.

Another object of the invention is to provide a new and improved construction for a semi-bulk transport bag, using a lifting harness formed of the same kind of woven material, preferably a plainwoven flat ribbon tape fabric, as the body of the bag, that affords improved distribution of lifting stress from the lifting members to the body of the bag without requiring any folds in the bag material at the points of attachment to the lifting members, and that facilitates assembly of the lifting harness to the body of the bag.

Another object of the invention is to provide a new and improved construction for a semi-bulk transport bag, using lifting members formed of the same type of woven material, preferably a plainwoven flat ribbon tape fabric, as the body of the bag, which makes it possible to employ a lighter weight material for a major portion of the bag body, with a stronger and heavier woven material used only for two side panels of the bag and with the transfer of lifting stress from the lifting members to the bag body confined to those two side panels.

Another object of the invention is to provide a new and improved construction for a semi-bulk transport bag having a lifting harness that remains upstanding and provides relatively wide openings that can be readily engaged for lifting by the tines of a fork lift truck.

A specific object of the invention is to provide a new and improved semi-bulk transport bag construction, utilizing lifting members made of the same type of woven material as the body of the bag, preferably a plainwoven flat ribbon tape fabric, that is simple and inexpensive in construction yet affords adequate safety factors in high capacity bags.

Another specific object of the invention is to provide a new and improved semi-bulk transport bag construction, utilizing lifting members made of the same type of woven material as the body of the bag, preferably a plainwoven flat ribbon tape fabric, which members are designed to equalize load stress, when used to lift the bag, across the full width of each lifting member a its juncture with each of the side panels to which the lifting member is secured.

Accordingly, in one aspect the invention relates to a semi-bulk transport bag having a volumetric capacity of the order of at least twenty cubic feet and a weight capacity of the order of at least about two thousand pounds, comprising a bottom panel and four side panels with the side panels joined at their edges to the bottom panel and to each other, the bag having four lifting members each anchored to the top of a respective corner of the bag, each of the side panels and the bottom panel being formed of a plainwoven flat ribbon tape panel fabric of high tensile strength. Each lifting loop comprises an elongated strip of at least three superimposed layers of the same type of woven fabric as the panel fabric, stitched longitudinally to form a loop member having a width W of at least about three inches. Furthermore, each lifting member has two end portions, each end portion having a height H of at least about six inches. Each lifting member end portion is secured to a top portion of a side panel of the bag by anchor stitching extending throughout the surface area of the lifting member end portion to distribute the transfer of lifting stress from the lifting member to an area of the side panel of approximately $W \times H$. The edges of the end portions of each lifting member are overlapped at the bag corners by an overlap width much smaller than W.

In another aspect, the invention relates to a semi-bulk transport bag of the kind having a volumetric capacity of the order of at least twenty cubic feet and a weight capacity of the order of at least about two thousand pounds, comprising a bottom panel and two side panels formed by a continuous U-shaped main body member and two additional side panel members with the side panel members stitched at their edges to the bottom panel and to the side panels of the main body member. The main body member is formed of a first uniform plainwoven panel fabric of high tensile strength and the side panel members are formed of a second, different uniform plainwoven panel fabric of high tensile strength. Only two lifting members are anchored to the top of the bag and engageable by the fork of a fork-lift truck, each lifting member having a width W of at least about five inches, and each lifting member extending from one corner of the bag to another, with each lifting member anchored only to two opposed side panels; each lifting member comprises a stiff elongated strip of at least three superimposed layers of a plainwoven fabric of the same type as the body and panel fabrics, stitched longitudinally to form a lifting member. Each lifting member has two end portions, each end portion having a height H of at least about six inches secured to a top portion of one of said two opposed side panels by anchor stitching extending throughout the surface area of the lifting member end portion to distribute the transfer of lifting stress from the lifting member to an area of the side panel of approximately $W \times H$; the plainwoven fabric for the two opposed side panels to which the lifting members are anchored is substantially heavier and stronger than the plainwoven fabric for the other two side panels of the bag.

BRIEF DESCRIPTION OF THE DRAWINGS

FIG. 1 is a perspective view of a semi-bulk transport bag constructed in accordance with one embodiment of the invention;

FIG. 2 is a plan view of the bag of FIG. 1 with a portion of a top cover cut away to reveal the bottom of the bag;

FIG. 3 is a perspective detail view illustrating how the top cover is incorporated in the bag of FIGS. 1 and 2;

FIG. 4 is a detail view illustrating the kind of plainwoven fabric used in the bag of FIGS. 1–3;

DESCRIPTION OF THE PREFERRED EMBODIMENTS

Figure 5:
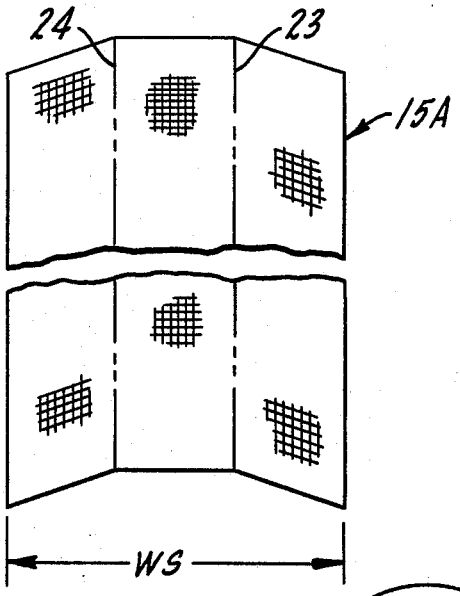
FIG. 5 is a detail view illustrating a strip of fabric employed in fabrication of one of the lifting members for the bag of FIGS. 1 and 2.

FIGS. 1 and 2 illustrate a rectangular semi-bulk transport bag 10 constructed in accordance with one embodiment of the invention. In FIG. 1, and in succeeding figures, the top cover that is usually provided on the bag has been omitted in order to show the internal construction of the bag.

The semi-bulk transport bag 10 of FIGS. 1 and 2 comprises a main body member formed of a continuous wide sheet of heavy duty panel fabric that is folded twice into a U-shaped configuration to form two side panels 11 and a bottom 13 (FIG. 2) for the bag. To complete the body of bag 10, two side panel members 12 and 14 are joined to the side panels 11 and the bottom panel 13 afforded by the main body member. Attachment of the side panel members 12 and 14 to the main body member is most economically and effectively accomplished, in each instance, by a continuous U-shaped stitched seam 16 joining the edges of the side panel to the main body member as shown in FIG. 1. Seam 16, typically, may comprise sixty-five pound test or stronger polyester twine.

Bag 10 includes a lifting harness comprising four lifting members or loops 15, one mounted at each corner of the body of the bag. Bag 10 may also include a top cover 17 (FIG. 2). In the illustrated construction, the dimensions of cover 17 are made slightly larger than the opening at the top of the walls 11, 12 and 14 of the bag so that cover 17 can be folded and stitched into the top of the bag by a single continuous seam 18 as shown in the detail view, FIG. 3. There is a central opening in cover 17 with an attached fill tube 19. Fill tube 19 may be provided with an attached tie 20 as shown in FIG. 2. Cover 17 may be a substantially lighter material than body panels 11–14. Alternatively, cover 17 may be equipped with a reusable fill/discharge opening having the construction described in Nattrass U.S. Pat. No. 4,364,424.

As thus far described, the semi-bulk transport bag 10 of FIGS. 1 and 2 is generally similar to a number of prior art bags, particularly those shown in the aforementioned Nattrass U.S. Pat. Nos. 4,307,764 and 4,364,424. The fabric used to form the main body member comprising side panels 11 and bottom panel 13 is preferably a burlap-weave material 22 having the construction shown on an enlarged scale in FIG. 4. Thus, panel fabric 22 is a coarse, heavy plainwoven fabric, woven from flat ribbon tape. The weight and strength of the panel fabric is dependent upon the size and capacity required for bag 10. Typically, the material 22 used for the main body member and for side panels 12 and 14 is woven from resin fibers such as polypropylene and has a tensile strength of at least three hundred pounds per inch in both warp and woof directions. Cut, non-selvage edges are preferably heat-sealed to preclude ravelling. The dimensioned D1, D2, an D3 for the body of bag 10 depend to a substantial extent on the required volumetric capacity for the bag; typically, each of these dimensions is of the order of three feet and the volume of bag 10, accordingly, is usually twenty-seven cubic feet or more, though some bags may have a smaller capacity down to about twenty cubic feet. The height D4 for each of the lifting harness members 15 is subject to variation but is usually at least ten inches.

The critical difference between bag 10 and the semi-bulk transport bags of the prior art is found in the construction of the lifting members or loops 15 and the manner in which those lifting loops distribute lifting stress to the body of the bag. The lifting loops or other lifting harness employed in a great majority of previously known bags are made of webbing, usually about two inches in width, that is many times stronger than the panel fabric 22. In bag 10, however, each lifting loop 15 is formed from an elongated strip 15A, FIG. 5, of the same plainwoven material 22 as is used for panels 11–14 in the bag body. The strip 15A used in fabrication of a lifting member for bag 10 has a length L at least one foot longer than twice the height D4 (FIG. 1) of finished lifting loop 15. The width WS of strip 15A, on the other hand, FIG. 5, is at least about nine inches and preferably is ten inches or more.

Figure 6:
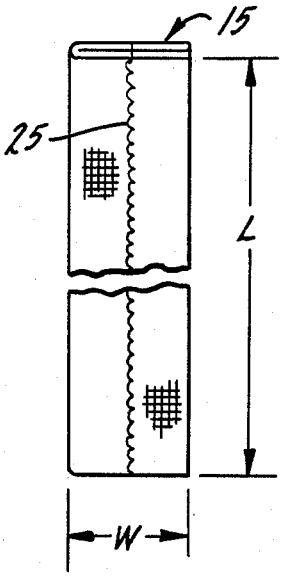
FIG. 6 is a detail view illustrating a lifting member made from the strip shown in FIG. 5.

To form a lifting loop 15 as shown in FIG. 6, the woven panel fabric strip 15A of FIG. 5 is folded longitudinally at least twice. In the specific construction shown in FIG. 5, strip 15A is folded along two longitudinal fold lines 23 and 24. The folded strip is then sewn longitudinally, as indicated by the stitching 25 in FIG. 6, and this completes the basic construction of the lifting member 15. As in seam 16, heavy duty polyester twine is preferably used for stitching 25. The lifting loop member should have a width W of at least three inches. The plural-layer lifting loop member 15 is much stiffer than a conventional webbing loop, a substantial advantage when the loop is to be engaged by the fork of a fork-lift truck.

Figure 7:
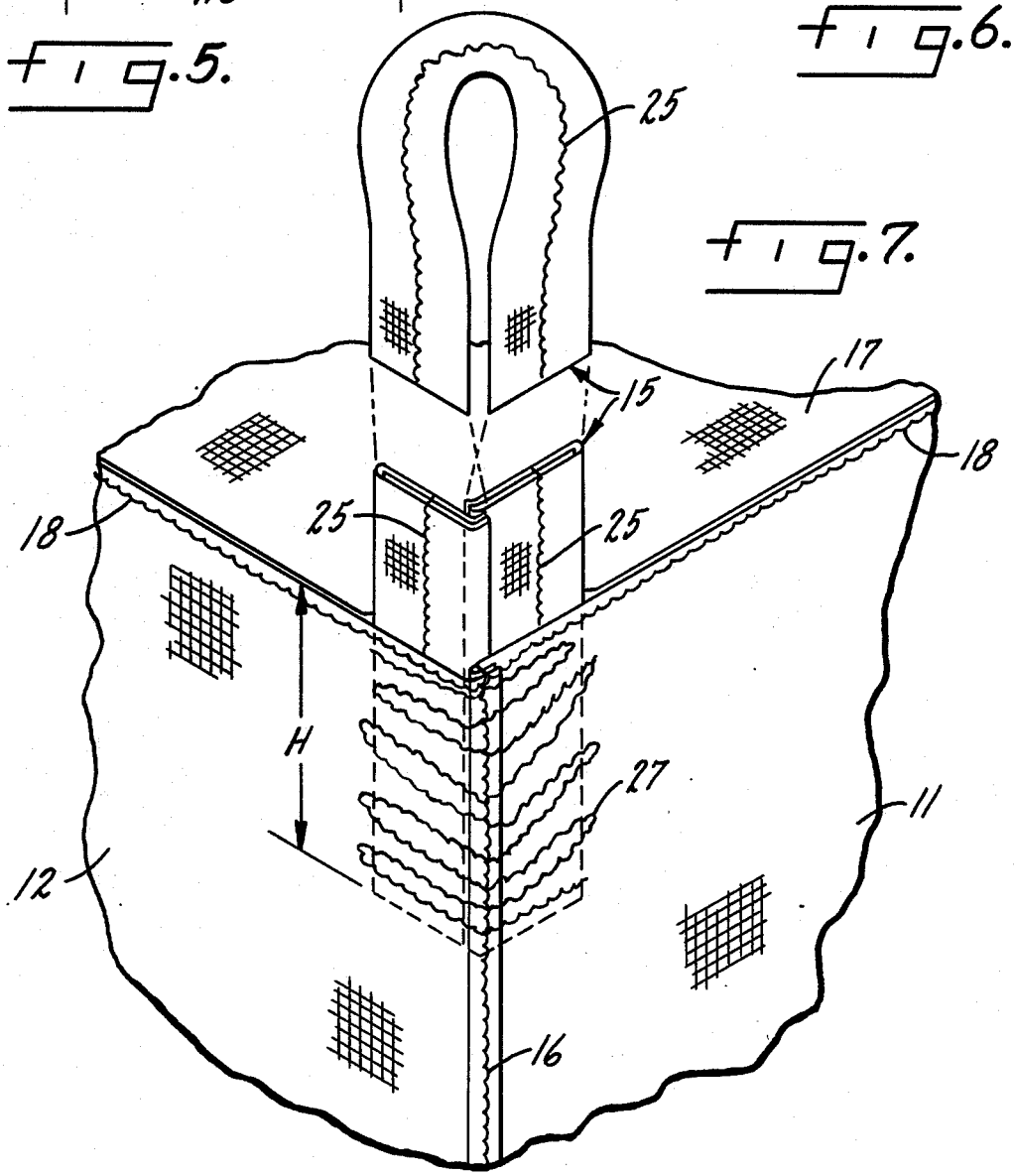
FIG. 7 is a detail view, on an enlarged scale, of one corner of the bag of FIGS. 1 and 2.

The attachment of the lifting member 15 to the body of the semi-bulk transport bag 10 is shown in FIG. 7. At the time when one of the side panels 12 is being sewn to an adjacent side panel 11 of the main body member for the bag, the edges of the ends of a lifting loop 15 are overlapped with each other, as shown in FIG. 7, and aligned with the top corner portions of side panels 11 and 12. The seam 16 that is used to join panels 11 and 12 also extends through the overlapped edges of the lifting loop member 15, so that the end portions of the lifting loop member are tacked into the corner of the bag body by stitching 16. Subsequently, continuous zig-zag anchor stitching 27 is applied throughout essentially all of the height H and width W (FIG. 6) of each end portion of lifting loop 15 that extends below the top edge of the bag. Height H is at least about six inches. Loop member 15 could be made longer, and could extend below anchor stitching 27, but any such extension would merely be a waste of fabric if not engaged by the anchor stitching. For anchor stitching 27, thirty-five pound test nylon thread is suitable.

It should be noted that neither of the side panels 11 and 12 is folded over the legs of lifting member 15. There is no need to fold the panel material over the lifting loop legs because the relatively large width W of the lifting member (three inches or more) distributes lifting stress to a sufficient width of each side panel so that the junction between the lifting loop and the body of the bag is strong enough to withstand the high stresses created when the loaded bag is lifted by a fork-lift truck or other like equipment. Furthermore, the initial tacking of loop 15 into the corner of the bag body, accomplished by positioning the loop at the top juncture of panels 11 and 12 before application of seam 16, holds the loop in place for subsequent application of anchor stitching 27.

Lifting loop member 15 could also be formed, for instance, from three or more separate strips of bag fabric, rather than using the folded construction of FIGS. 5–7. In a construction of that kind two longitudinal seams should be used at the edges of the loop strips. The folded construction shown in the drawings is preferable, however; it is inherently stronger and sturdier.

Figure 8:
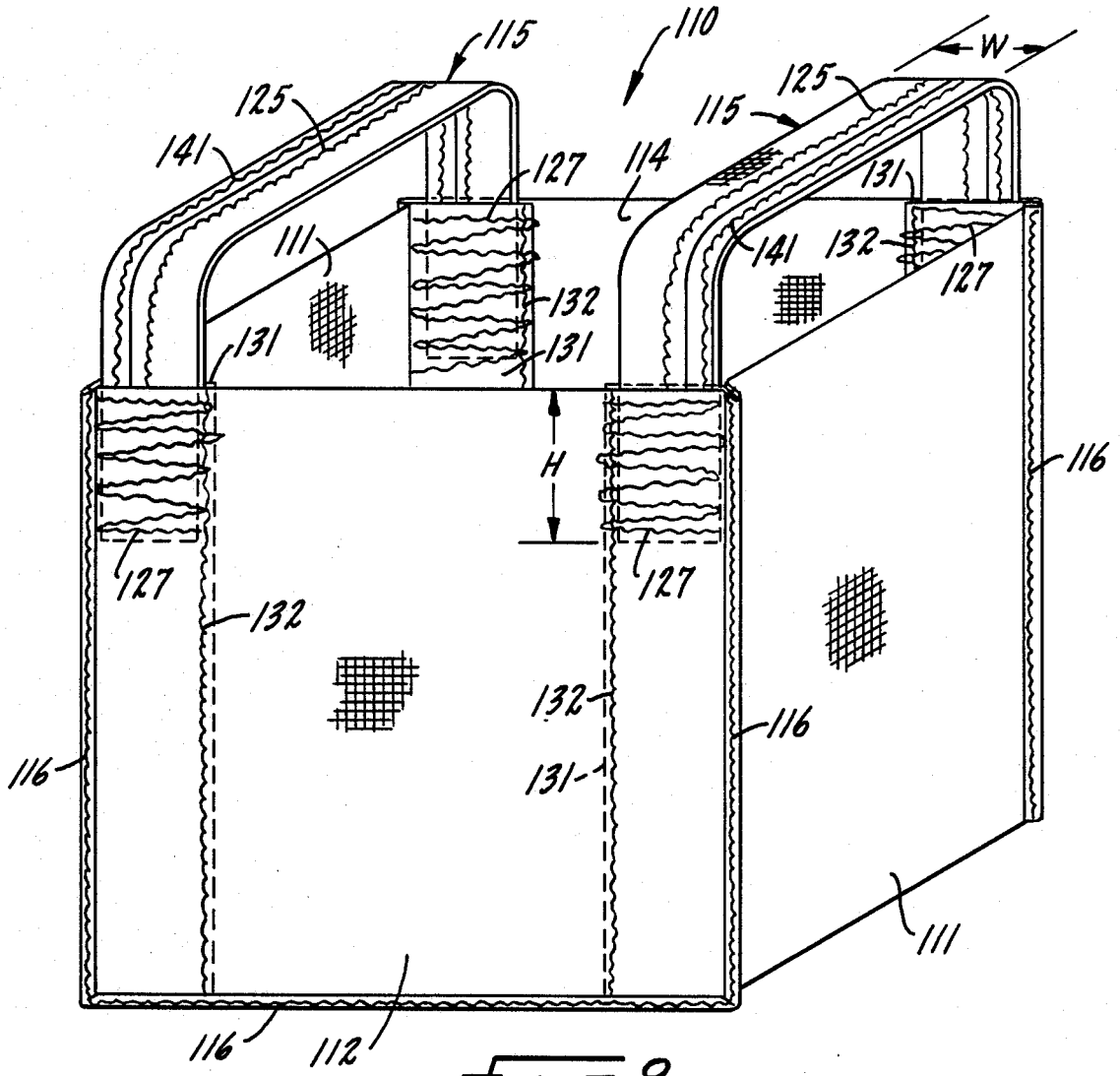
FIG. 8 is a perspective view illustrating another embodiment of the invention.
Figure 9:
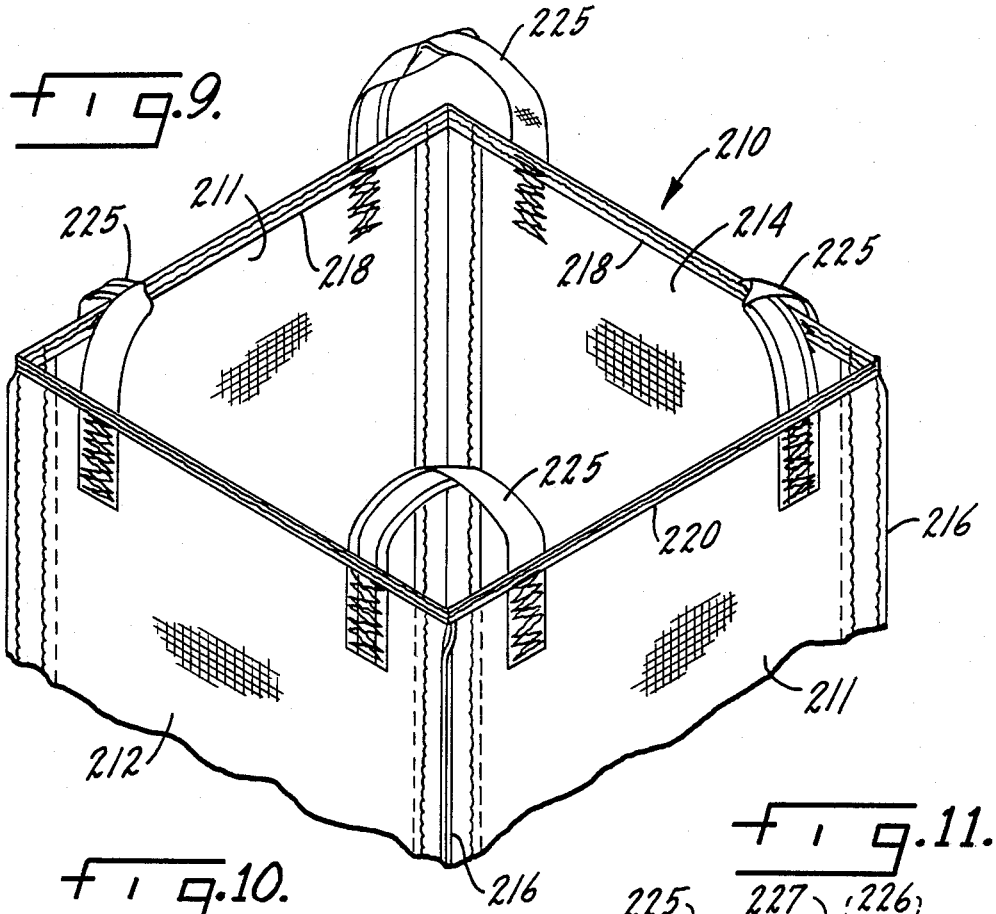
FIG. 9 is a perspective view of the top portion of a semi-bulk transport bag constructed in accordance with another embodiment of the invention.

FIG. 8 illustrates a semi-bulk transport bag 110 constructed in accordance with another embodiment of the invention. Bag 110 includes a main body member affording two side panels 111 that are part of a continuous strip with a bottom panel for the bag (not shown). The main body member is joined to two side panel members 112 and 114 by two continuous U-shaped seams 116, as in the previously described embodiment. The top of bag 110 is shown as being open, but the bag can be provided with a top cover as previously described. All of the bag panels are made of plainwoven flat ribbon tape fabric.

In bag 110, each of the side panel members 112, 114 is provided with two vertical hems 131, each hem located immediately adjacent an edge of the side panel member joined to one of the side panels 111 of the main body member. Seams 132 are used to secure the edges of hems 131.

Bag 110 includes just two lifting members 115. Like the lifting loops 15 of the previously described embodiment, each lifting member 115 is formed from an elongated strip of the same type of plainwoven flat ribbon tape fabric as used in the panels of the bag body, folded longitudinally at least twice and stitched longitudinally as indicated at 125 to form the lifting member. In bag 110, each strip used to form a lifting member 115 should have a width WS (FIG. 5) of at least about fifteen inches so that the effective width W of each lifting member 115 is at least five inches. As in bag 10, the lifting members 115, though not stiff enough to stand erect, are much stiffer than conventional webbing loops, adding materially to the ease of use in engaging the lifting members with a fork-lift.

In bag 110, the lifting members 115 are not sewn into the bag corners in the same manner as in bag 10, FIGS. 1, 2 and 7. Instead, the end portion of each lifting member 115 is inserted into one of the side panel hems 131 to a height H of about six inches or more and is then anchor stitched into the hem of the side panel member by zig-zag anchor stitching 127. It is thus seen that the lifting members 115 are not directly attached to the main body member that affords side panels 111. Instead, the lifting loop members are mounted only on the two side panel members 112 and 114. Each outer edge of the lifting members may be further protected and reinforced by a piece of webbing 141 folded over and sewn to the edge of the lifting member; see FIG. 8.

Bag 110, FIG. 8, particularly due to the relatively great width of lifting members 115, affords adequate strength and stress distribution for those occasions on which the filled bag is lifted by means of lifting members 115, even when the lifting motion is rough and abrupt. Furthermore, because the lifting members are attached only to the side panel members 112 and 114 and not to the main body member affording side panels 111, it is possible to use a lighter weight fabric for the main body member than for the side panel members without sacrificing weight capacity and strength characteristics for the bag. Typically, if side panel members 112 require an eight ounce woven material, the fabric used for the main body may be six and a quarter ounce or even five ounce material. Thus, bag 110 affords a substantial cost saving with no sacrifice in bag strength or capacity. Of course, this construction can be varied by attaching lifting members 115 to side panels 111 rather than panels 112 and 114, in which case the lighter fabric is used for side panels 112 and 114 and the heavier material for the main body member comprising panels 111. In bag 110, seams 116 and stitching 125 preferably use the heavy duty polyester twine referred to above for stitching 16 and 25 in bag 10; stitching 127 and 132 can use lighter nylon thread.

In both bag 10 and bag 110 the lifting members are substantially stiffer than conventional webbing loops, and hence more convenient to use in mounting on the tines of a fork lift. The plural-layer lifting members are tough and strong, yet quite inexpensive as compared with webbing loops. Furthermore, the wide lifting members distribute lifting stresses effectively without requiring folding into multiple layers of the body panels or other such expedients.

FIGS. 9 through 12 illustrate a semi-bulk transport bag 210 constructed in accordance with another embodiment of the invention. Bag 210 includes a main body member affording two side panels 211 that are part of a continuous strip with a bottom panel for the bag (not shown). The main body member is joined to the two side panels 212 and 214 by two continuous U-shaped seams 216, as in the previously described embodiments. The top of bag 210 is shown as being open, but the bag can be provided with a top cover as previously described. All panels are made of a plainwoven, flat ribbon tape fabric, a burlap-like weave as shown in FIG. 4.

The top edges of the side panels 211, 212 and 214 are folded inwardly to form a hem 218 around the top of the bag. A narrow webbing 220 is attached to the outside of the hem and secured thereto by a double row of stitching 222 using heavy duty polyester twine.

Bag 210 includes four lifting members 225. Like the lifting members 15 and 115 of the previously described embodiments, each lifting member 225 is formed from an elongated strip of the same type of plainwoven burlap-like fabric as is used in the panels of the bag body, folded longitudinally at least twice to form a multi-layered strip 225 as shown in enlarged cross-section in FIG. 12 of the drawings. The overall strip length may be thirty-six inches or more. Strips of narrow webbing 226, similar to webbing 220, may be positioned on one side of each lifting member 225 along each longitudinal edge thereof and attached to the loops as by longitudinal stitching 227. Two rows of stitching 227 are shown at the open side of the three layered loop while a single row of stitching 227 is shown along the other side of the loop. In bag 210, each elongated strip used to form a lifting member 225 should have a width WS (FIG. 5) of at least about twelve inches and the effective width W of each lifting loop member 225 is preferably about four inches or more.

The lifting members 225 are inherently much stiffer than conventional webbing loops, due to their multi-ply construction. Lifting member stiffness is also increased by the strips of webbing 226 when employed. The stiffness of these lifting members causes them to tend to stand upright, providing high, wide openings 230 (FIG. 11) to receive the tines of a forklift truck. The wide openings are obtained by fastening the ends of the lifting members to the side panels 211, 212 and 214 of the bag at points displaced from the corners of the bag by distances S which are substantially greater than the widths of the loops. As is shown most clearly in FIGS. 10 and 11 the edge of one end of a lifting member 225, which is approximately four inches wide in this embodiment, is positioned at a spacing S approximately six to ten inches from the corner of the bag. The opposite end of the lifting member is attached to the adjacent panel of the bag with its edge also positioned approximately six to ten inches from the corner of the bag. This spacing of the ends of each lifting member from the bag corner provides an opening of substantial height which is more than six inches wide, from virtually any angle, for the insertion of a forklift tine.

Figure 12:
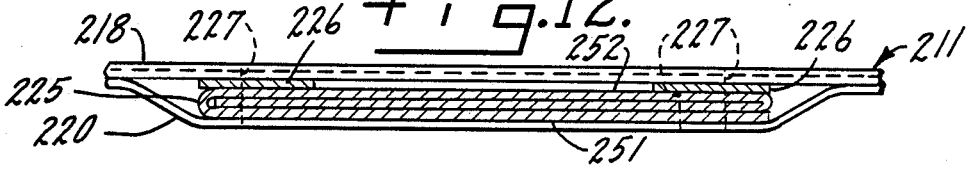
FIG. 12 is a cross-section view, on a enlarged scale, taken along line 12—12 of FIG. 11.

In attaching lifting members 225 to side panels 211, 212 and 214, the ends of each lifting member are preferably placed between webbing 220 and the outer faces of the side panels. At one end of each lifting member 225, as shown in FIG. 12, webbing strips 226 on the lifting member engage the side panel. However, the lifting members can be secured to the inner surfaces of the side panels, rather than the outer surfaces as shown, if desired.

Figure 10:
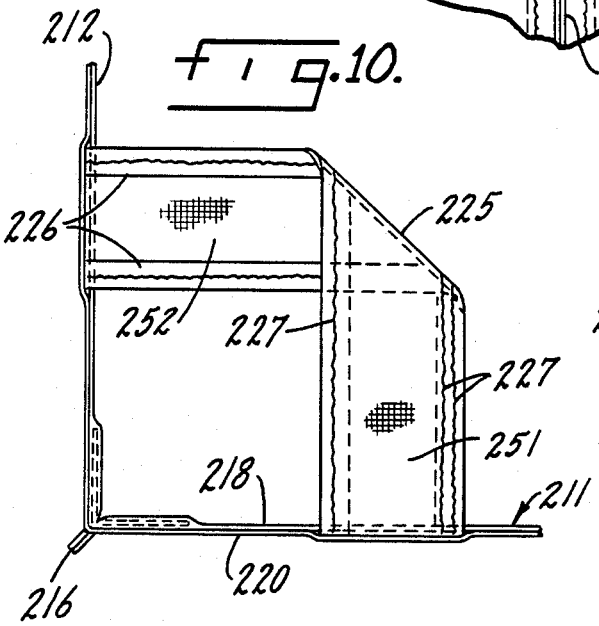
FIG. 10 is a plan view, on an enlarged scale, of one corner of the bag of FIG. 9.
Figure 11:
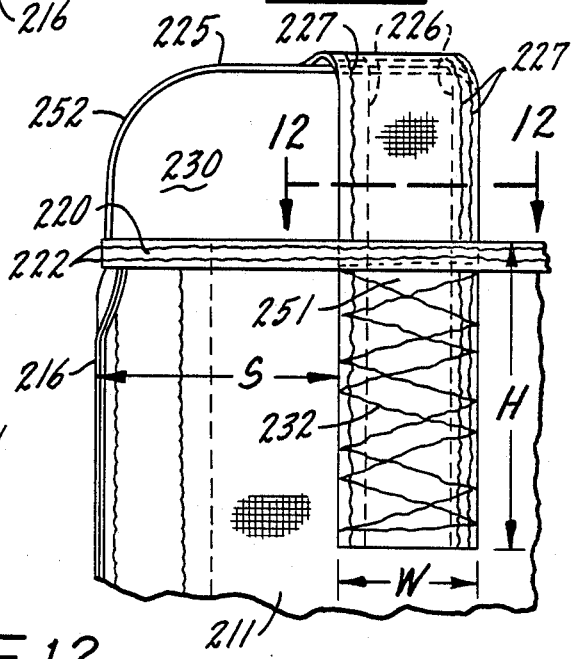
FIG. 11 is a side elevation view of the corner of the bag shown in FIG. 10.

Each lifting member 225 is twisted, as shown in detail in FIGS. 10 and 11, so that the strips 226 of webbing face outwardly from the side panel of the bag when this end of the loop is fastened to the side panel. That is, each lifting member 225 is twisted so that one surface 251 is on the outside of the bag at the end of the lifting member secured to one panel whereas the other surface 252 is on the outside of the end secured to the other panel (see FIGS. 10 and 11). Fastening of the ends of the lifting members is preferably accomplished by zig-zag anchor stitching 232 applied throughout essentially all of the height H of each end portion of each lifting member 225, with H preferably being approximately six inches or more.

One reason for twisting each lifting member 225 is to obtain more even distribution of the stresses which are applied to the side panels when the transport bag 210 is lifted by members 225. If a lifting member is attached in the conventional manner with the same sides facing the side panel at both ends, the edge of the lifting member which is remote from the corner of the bag will be required to sustain virtually all stress when the bag is lifted; the edge of the lifting member closer to the corner will carry virtually no stress. By twisting each lifting member, the edge farthest from the corner at one end of the lifting member becomes the edge closest to the corner at the opposite end of the lifting member, thus distributing stress throughout the width of the lifting member at both ends. The twist in each lifting member 225 also increases its rigidity, enabling it to stand more erectly. Thus, the twisted, spread lifting member construction of FIGS. 9–12 affords a stronger, more durable bag construction that also facilitates engagement of the lifting members by a lift truck fork without damage to the lifting members. Twisted loops have sometimes been used in the past, but in arrangements using a limp webbing in which these advantages have not been achieved.

The twist used in the lifting members 225 of bag 210, FIGS. 9–12, can also be used to advantage in the lifting loops 25 of bag 10, FIGS. 1–7. The edge-to-edge stress distribution function of the twist in loops like those of bag 10 is less critical because the lifting member legs are immediately adjacent each other, but the added rigidity afforded by the twist is quite advantageous.

Figure 13:
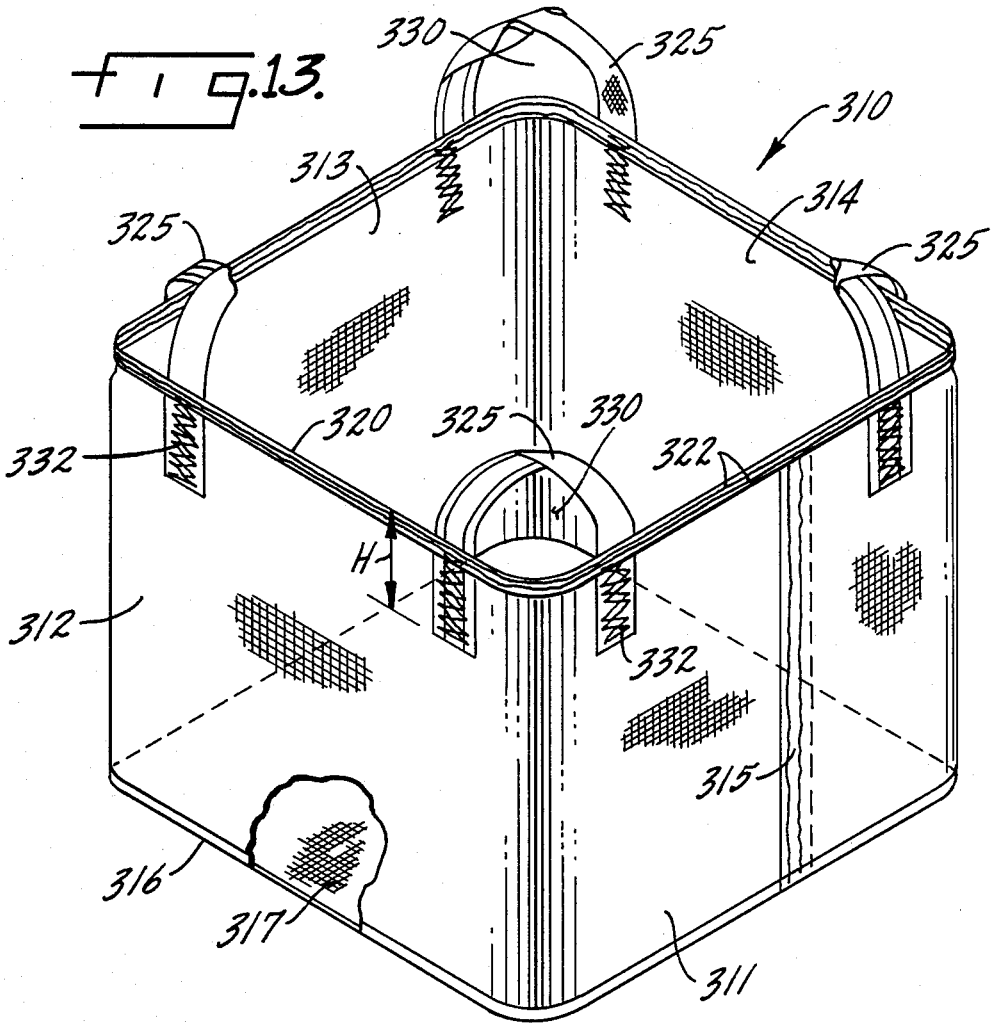
FIG. 13 is a perspective view of a semi-bulk transport bag constructed in accordance with another embodiment of the invention.
Figure 14:
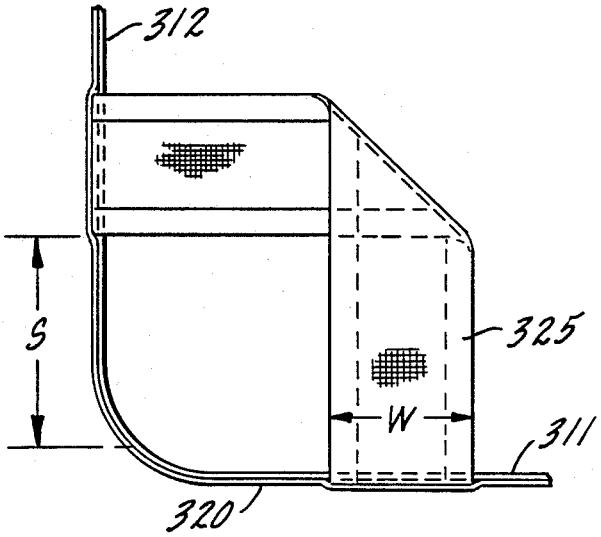
FIG. 14 is a plan view, on an enlarged scale, of one corner of the bag of FIG. 13.

FIGS. 13 and 14 illustrate a semi-bulk transport bag 310 constructed in accordance with yet another embodiment of the invention. Bag 310 includes a continuous side panel member affording four side panels 311–314 that are part of a continuous strip joined together at an overlap 315 in panel 311. The side panel member is joined to a bottom panel 317 by a continuous seam 316. Bottom panel 317 is rectangular, and this establishes an essentially rectangular cross-sectional shape for bag 310. As before, all panels are formed of a flat ribbon tape plainwoven fabric, essentially a burlap-like weave. The top of bag 310 is shown as being open, but the bag can be provided with a top cover as previously described. The top edges of panels 311–314 may be folded inwardly to form a hem around the top of bag 310. A narrow webbing 320 is preferably attached to the outside of the hem and secured thereto by a double row of stitching 322 of heavy duty polyester twine.

Bag 310, like each of bags 10 and 210, has four lifting members 325, each formed from an elongated strip of the same type of plainwoven fabric as is used in the body panels, folded longitudinally at least twice to form a multi-layered strip. The construction may be as shown in enlarged cross-section, in FIG. 12, for members 225, and may include webbing elements as shown at 226 in FIG. 12. The overall strip length may be thirty-six inches or more. In bag 310, as in bag 210, the effective width W of each lifting loop member is preferably about four inches or more, though three inch wide lifting members may be adequate for some bags. Wide openings 330, for ready reception of fork lift tines, are obtained by fastening the ends of lifting members 325 to side panels 311–314 of bag 310 at points displaced from the corners of the bag by distances S which are appreciably greater than loop width W. As in FIGS. 9–12, this spacing of the ends of each lifting member from the bag corner provides an opening of substantial height and width, accessible from virtually any angle, for the insertion of a forklift tine. In attaching lifting members 325 to side panels 311–314, each end of each lifting member is preferably placed between webbing 320 and the outer face of the side panel. However, the lifting members can be secured to the inner surfaces of the side panels, rather than the outer surfaces as shown, if desired.

Each lifting member 325 is twisted, as shown in detail in FIGS. 13 and 14, in the same manner as loops 225 in FIGS. 9–12. Fastening of the ends of the lifting members is preferably accomplished by zig-zag anchor stitching 332 applied throughout essentially all of the height H of each end portion of each lifting member 325; H preferably is approximately six inches or more. The twist provides more even distribution of stresses applied to the side panels when bag 310 is lifted by members 325. The twist in each lifting member 325 also increases its rigidity, enabling it to stand more erectly.

Figure 15:
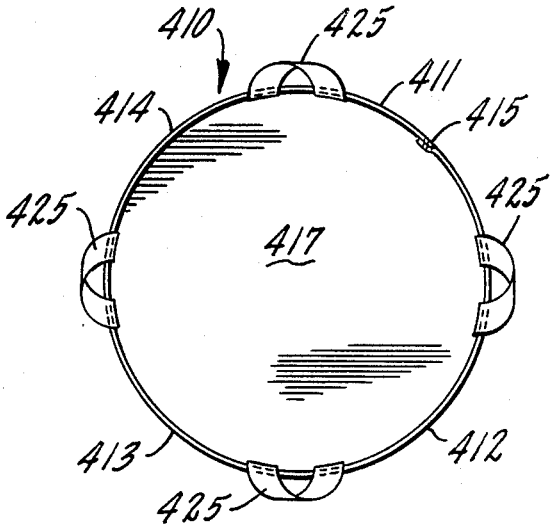
FIG. 15 is a plan view, on a reduced scale, of a variation in the bag of FIGS. 13 and 14.

FIG. 15 affords a plan view of a semi-bulk transport bag 410 that is quite similar to the bag 310 of FIGS. 13 and 14 except that the bottom panel 417 in bag 410 has a circular outline instead of a rectangular configuration. Nevertheless, there are still four side panels 411–414, though they are curvilinear i shape rather than flat; the extent of the side panels is defined by four lifting members 425 secured at equally spaced intervals about the top edge of the continuous bag body member that provides the side panels. Inasmuch as the side panels 411–414 are a part of a tubular construction, they may be woven originally in tubular form; more practically, however, the side panels may be formed of a continuous strip of material joined at a seam 415. In all other respects, the construction for bag 410 may be the same as for the bag 310 of the previously described embodiment.

I claim:

1. A semi-bulk transport bag having a volumetric capacity of the order of at least twenty cubic feet and a weight capacity of the order of at least about two thousand pounds, comprising a bottom panel and four side panels with the side panels joined at their edges to the bottom panel and to each other, the bag having four lifting members each anchored to the top of a respective corner of the bag and engageable by the fork of a fork-lift truck, each of the side panels and the bottom panel being formed of a uniform plainwoven panel fabric of high tensile strength, in which:

each lifting member comprises a stiff elongated strip of at least three superimposed layers of the same type of woven fabric as the panel fabric, stitched longitudinally to form a stiff lifting member having a width W of at least about three inches;

and each lifting member has two end portions, each end portion having a height H of at least about six inches;

each lifting member end portion being secured to a top portion of a different side panel of the bag by anchor stitching extending throughout the surface area of the lifting member end portion to distribute the transfer of lifting stress from the lifting member to an area of the side panel of approximately $W \times H$;

and the edges of the end portions of each lifting member being overlapped at the bag corner by an overlap width much smaller than W.

2. A semi-bulk transport bag according to claim 1 in which each lifting member loop has a single twist to increase the stiffness of the loop.

3. A semi-bulk transport bag according to claim 1, in which the overlapped edges of the end portions of each lifting loop member are tacked to the bag corner by stitching joining the bag side panels to each other.

4. A semi-bulk transport bag having a volumetric capacity of the order of at least twenty cubic feet and a weight capacity of the order of at least about two thousand pounds, comprising:

a bottom panel and two side panels formed by a continuous U-shaped main body member and two additional side panel members with the side panel members stitched at their edges to the bottom panel and to the side panels of the main body member;

the main body member being formed of a first uniform plainwoven panel fabric of high tensile strength and the side panel members being formed of a second, different uniform plainwoven panel fabric of high tensile strength;

only two lifting members anchored to the top of the bag and engageable by the fork of a fork-lift truck, each lifting member having a width W of at least about five inches, and each lifting member extending from one corner of the bag to another, with each lifting member anchored only to two opposed side panels;

each lifting member comprising a stiff elongated strip of at least three superimposed layers of a plainwoven fabric of the same type as the body and panel fabrics, stitched longitudinally to form a lifting member;

and each lifting member having two end portions, each end portion having a height H of at least about six inches secured to a top portion of one of said two opposed side panels by anchor stitching extending throughout the surface area of the lifting member end portion to distribute the transfer of lifting stress from the lifting member to an area of the side panel of approximately $W \times H$;

and the plainwoven fabric for said two opposed side panels to which the lifting members are anchored being substantially heavier and stronger than the plainwoven fabric for the other two side panels of the bag.

5. A semi-bulk transport bag according to claim 4, in which each of said two opposed side panels to which the lifting members are anchored includes a vertical hem having a width greater than W, and in which each end portion of each lifting member is inserted into and anchored in the top of one of the side panel hems.

6. A semi-bulk transport bag according to claim 4 in which a strip of protective webbing is folded over and sewn to the outer edge of each lifting member.

* * * * *